US005361907A

United States Patent [19]

Mohrhäuser

[11] Patent Number: 5,361,907

[45] Date of Patent: Nov. 8, 1994

[54] BOX FOR STORING AMPULES

[75] Inventor: Klaus Mohrhäuser, Waldkirch, Germany

[73] Assignee: August Faller KG, Waldkirch, Germany

[21] Appl. No.: 110,077

[22] Filed: Aug. 20, 1993

[30] Foreign Application Priority Data

Apr. 5, 1993 [DE] Germany ..... 4311145

[51] Int. Cl.[5] ..... B65D 81/02; B65D 73/00

[52] U.S. Cl. ..... 206/528; 206/443; 206/485

[58] Field of Search ..... 206/485, 528, 530, 443, 206/446

[56] References Cited

U.S. PATENT DOCUMENTS 4,450,965 5/1984 Paillet ..... 206/528

FOREIGN PATENT DOCUMENTS 0491399 12/1991 European Pat. Off. .

758120 10/1933 France ..... 206/485

283896 3/1931 Italy ..... 206/485

434744 5/1948 Italy ..... 206/485

264474 1/1950 Italy ..... 206/485

459159 8/1950 Italy ..... 206/485

*Primary Examiner*—Bryon P. Gehman

*Attorney, Agent, or Firm*—Flynn, Thiel, Boutell & Tanis

[57] ABSTRACT

A new type of box for the packaging of ampules or the like exhibits hollow walls (4 and 5) separated from each other having a triangular shaped cross-section, with lengthwise sidewalls (2 and 3) and a box bottom (1) which are so joined with one another that ampules (10), or the like, which are stored, in a clamping fashion, in the cutouts of the hollow walls (4 and 5), due to their resilient support, do not come in contact with the bottom of the box (1) even under pressure from above. This construction has, furthermore, the advantage that both ends of the ampules (10) are free and can easily be gripped with the fingers at these locations to be removed from the box.

15 Claims, 4 Drawing Sheets

BOX FOR STORING AMPULES

BACKGROUND OF THE INVENTION

The invention concerns a box or a box-insert in particular for accepting ampules or the like, whereby two largely parallel hollow walls, separated and lying across from each other, each formed from a reinforcement wall attached to and projecting outward from a box bottom and a support wall connected to the reinforcement wall and at least partially connected to the neighbouring lengthwise side wall, and which exhibit cutouts which lie across and are separated from each other and which are adapted for holding an ampule or the like.

A box of this kind or a box-insert of this kind is known in the art from EP-A-0 491 399.

In the box known in the art the ampules or the like are held by the cutouts in the edges forming the hollow walls of the reinforcement walls lying across from another, e.g. are supported in a pointlike fashion at two separate points, and lie with their forward and backward ends completely within the hollow wall and below the support walls which form a flat covering surface.

The box construction which is known in the art has the following distinguishing characteristics:

- Since only two support points for ampules or the like are available in the box, which, in addition are located rigidly with respect to the box bottoms, the box, in order to protect the ampules or the like during the course of rough industrial shipping must be relatively sturdy, e.g. constructed from materials in a costly fashion and, furthermore, must spaciously enclose the ampules;
- Due to the rigid support at only two points, the ampules or the like cannot yield resiliently in response to the occurence of pressure from above, as can take place when the boxes are stacked on top of each other;
- Since the ampules are enclosed spaciously by the box material, it is difficult to access the ampules or the like in order to remove them from the box, in particular, when the box is completely filled.

It is, therefore, the purpose of this invention to provide a box which is improved compared to the box known in the art or an improved box-insert for ampules or the like, such that less material is used for production and a more flexible support of the ampules or the like in the box is achieved.

SUMMARY OF THE INVENTION

The purpose of the invention is achieved with a box or box insert having two substantially parallel hollow walls which lie across and at a separation from each other, and are each formed from a reinforcement wall joined to and extending outward from a box bottom and a support wall which is attached to the reinforcement wall and at least sectionally to a neighboring lengthwise sidewall, whereby the hollow walls exhibit cutouts, each separated and lying across from another, which are adapted for holding an ampule or the like, and both hollow walls have triangular shaped cross-sections at least in a middle region holding the ampules, with each supporting wall comprising a first section which extends from the upper end of the reinforcement wall in the direction of the box bottom, and a second section, joined to the first section, which extends upwardly to the neighboring lengthwise sidewall, so that the ampule or the like lies with both ends free from the corresponding support wall.

Accordingly, the essential feature of the invention is that both hollow walls are triangular shaped in cross-section, at least in a central region where the ampules are supported, whereby each support wall is comprised of a first section which extends outwardly from the upper end of the reinforcement wall in the direction of the box bottom, and from a second section adjacent to the first section and attached to it which extends upwardly to the neighbouring lengthwise side wall, and the ampule or the like lies free from the support walls at both ends.

In this fashion it is possible with the invention for the ampules to be held in the box at four support points, with this novel support, facilitated by the particular construction of the hollow walls, yielding flexibly in response to pressure from above. Since the ampules lie freely at both ends, they can be easily gripped at both ends and removed, even when the box is completely filled. The new proposed box also exhibits significant material savings compared to the box known in the art, essentially since, due to the resilient flexible support of the ampules, the wall sections of the hollow walls and the lengthwise side walls can both be narrower and have reduced wall thicknesses.

Although, in the following description a box is always described it can also clearly be utilized as a box insert with or without the cover, which is described in a preferred embodiment.

This box or this box insert serve, in particular, to accept ampules or similar elongated objects which are sensitive to pressure or shock, but can, however, with appropriate forming of the cutouts in the hollow walls, be utilized to receive, pack, or ship, store or the like any kind of elongated objects so that the designation "ampule" which is used in the following description cannot be interpretated in a limiting fashion.

It is preferred when the hollow wall cutouts in the reinforcement wall region are so configured that the reinforcement walls hold the ampule or the like in a clamping fashion, whereby the ampules lie on one edge of the reinforcement walls and are so configured in the cutouts in the region of the support walls that the ampules or the like lie with their lower side upon an upper edge of the support walls.

In a preferred improvement the first section of the support wall is connected to the second section via a first hinge joint or perforation and the cutouts lie only within the first section of the support wall.

This measure simplifies the folding up and shaping of the box from a blank, whereby the second section turns upward at an angle with respect to the first section of the support wall towards the neighbouring lengthwise side wall to which, by means of the hinge joint or perforation, it is connected in a hinged fashion, and the second section, together with the lengthwise side wall form a flexible support region which is resilient in a certain region.

In this preferred embodiment of the box the ampules never lie on the box bottom. Should therefore pressure be exerted from above, by way of example, on the cover, the packaged ampules are supported resiliently and can yield away from this pressure.

In a particularly preferred embodiment of the box in accordance with the invention, each hollow wall is formed from a central region which has the described triangular shaped cross-section and from two outer regions lying adjacent thereto having rectangular cross-sections, whereby the first and the second support wall section of the central hollow wall region are each separated, by a cutout which extends to the side wall, from the reinforcement and support wall of the correspondingly adjacent outer hollow wall region.

The box can be advantageously and economically produced if, at least the box bottom, the lengthwise side walls, and the hollow walls are made from a single blank which can be formed into the box using conventional procedural steps, whereby, if necessary, certain sections can be glued to each other.

It is preferred when each reinforcement wall is connected to the bottom by means of a base strip which is integral with the reinforcement wall and configured as a gluing tab. Each of these base strips is preferentially folded over from the base line of the corresponding reinforcement wall to the inside of the hollow wall and glued to the bottom at an adjacent surface. Side tabs are furthermore preferred which are integral with the box bottom and which, by means of a connecting fold line, form cross side walls, whereby these side tabs exhibit insertion tabs which, when the side tabs are erect, insert into and close the front side of the hollow walls.

It is preferred when the erect side tabs with their insertion tabs are not glued to the support walls of the outer sections of the hollow walls, rather the lengthwise side walls have, at the front side of the hollow wall, foldable folding taps which are positioned within the erected side tabs and which are provided with locking toes which cooperate in a locking fashion with locking slots in the insertion tabs of the side tabs so that, in the assembled state, the side tabs lock with the lengthwise side walls via the insertion tabs and close the front side of the hollow walls.

However, it is also possible for the side tabs to be glued to the front side of the hollow walls. In this fashion it is possible to save material since the insertion tabs can be eliminated.

Within the framework of the invention, a single-piece cover is proposed which is glueable to the outer side of one of the lengthwise side walls for closing the upper part of the box and which is connectable to the oppositely lying lengthwise side wall by means of a closing flap in a fashion which is tearable. This closing flap exhibits preferentially at least one section which is glueable to the outer side of the neighbouring lengthwise side wall of the box, the section being connected to the closing flap by means of a perforation line which forms a first-opening seal.

Further advantageous characteristics are described with reference to the drawings which represent the principle of the invention and, subsequently, in a preferred embodiment. In the figures of the drawing:

DETAILED DESCRIPTION OF THE PREFERRED EMBODIMENT

Figure 1:
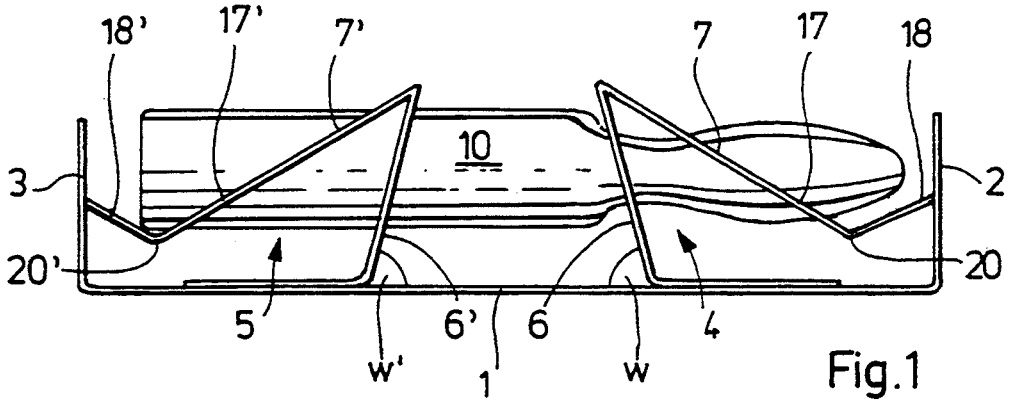
FIG. 1 shows a cross-section of the principle for storing and supporting ampules in a box in accordance with the invention.

FIG. 1 shows the principle for receiving and holding ampules 10 in a box which exhibits hollow walls 4 and 5 formed from reinforcement walls 6, 6' and support walls 7, 7' connecting to lengthwise walls 2 and 3 and a bottom 1. FIG. 1 clearly shows that the support walls 7 and 7' are comprised of two sections 17, 18 and 17', 18', respectively, whereby both of these support wall sections are so angled at bending edges 20, 20' that the hollow walls 4 and 5 are approximatively triangular shaped in cross-section. These bending edges 20 and 20' are hinge joints which are formed by perforation lines. FIG. 1 further shows clearly that despite stored ampules 10, the lower most portions of the support wall sections 17, 18 or 17', 18', which are defined by the bending edges 20, 20' do not lie on the box bottom 1. Between each box bottom 1 and the support wall section 6, 6' is an angle W or W' respectively which is somewhat less than 90°. With this measure, the resilient support and storage of the ampules 10 in the box according to the invention is even more improved.

Figure 2:
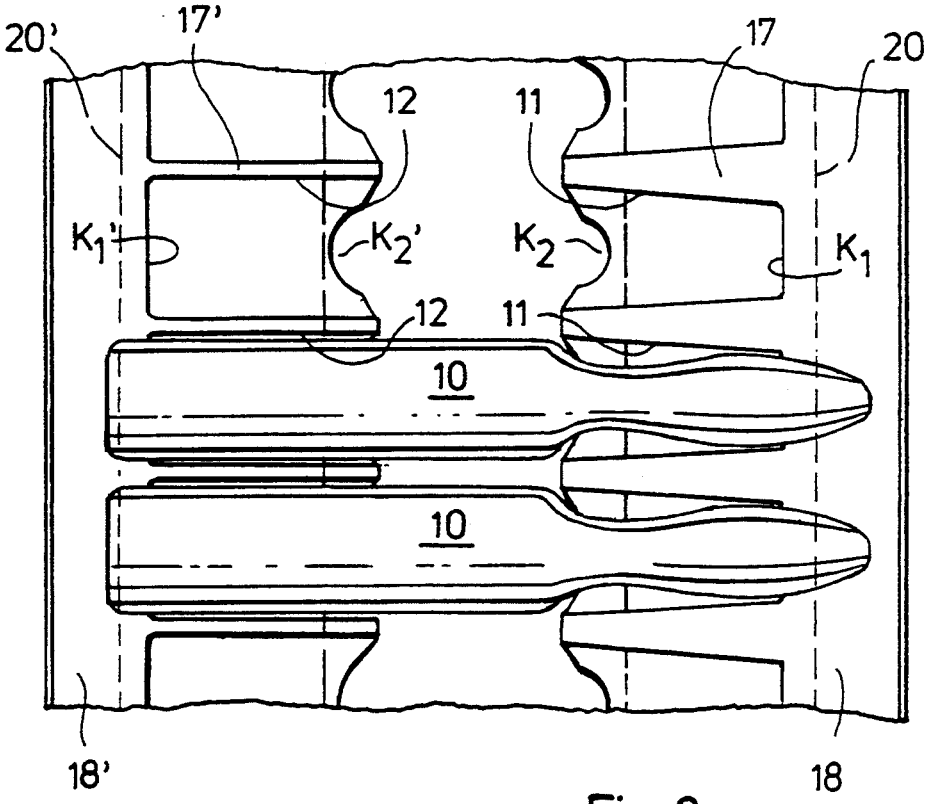
FIG. 2 shows a plan view of a section of the inventive box according to FIG. 1.

FIG. 2 shows a cutout of the box in accordance with the invention in plan view, whereby adjacent to two ampules 10 which in the manner depicted in FIG. 1, are supported and stored in the box a free receiving location remains, order to illustrate the cutouts 11 and 12 of the hollow walls 4 and 5 which are provided for in the support wall 6 and 6' and in the first support wall section 17, 17' of which the upper ends are connected, for holding and supporting the ampules 10. FIGS. 1 and 2 show in addition, that the ampules 10 are not, at either end, surrounded by box material, rather lie free from the inside of the lengthwise side walls 2 and 3. In this fashion, the ampules 10 lie in the box essentially on four corners K1, K1' and K2, K2' which are each formed at the carrying wall sections 17 and 17' and the support walls 6 and 6' due to the cutouts 11 and 12. The ampules are furthermore held in a clamping fashion in the sections 11 and 12. For a material-saving, light and thereby inexpensive manufacture of the box, the remaining bridges in the reinforcement walls 6 and 6' and in the support wall section 17 and 17' between the cutouts 11 and 12 are relatively narrow and the ampules 10 are packed with small relative separation within the box. Since the ampules 10 are free at their forward and backward ends, they can be simply grasped and removed from the box, even when the box is completely filled with ampules. In particular it is, thereby, not necessary to reach underneath the ampule 10, that is between the bottom 1 of the box and the ampule 10.

Figure 3:
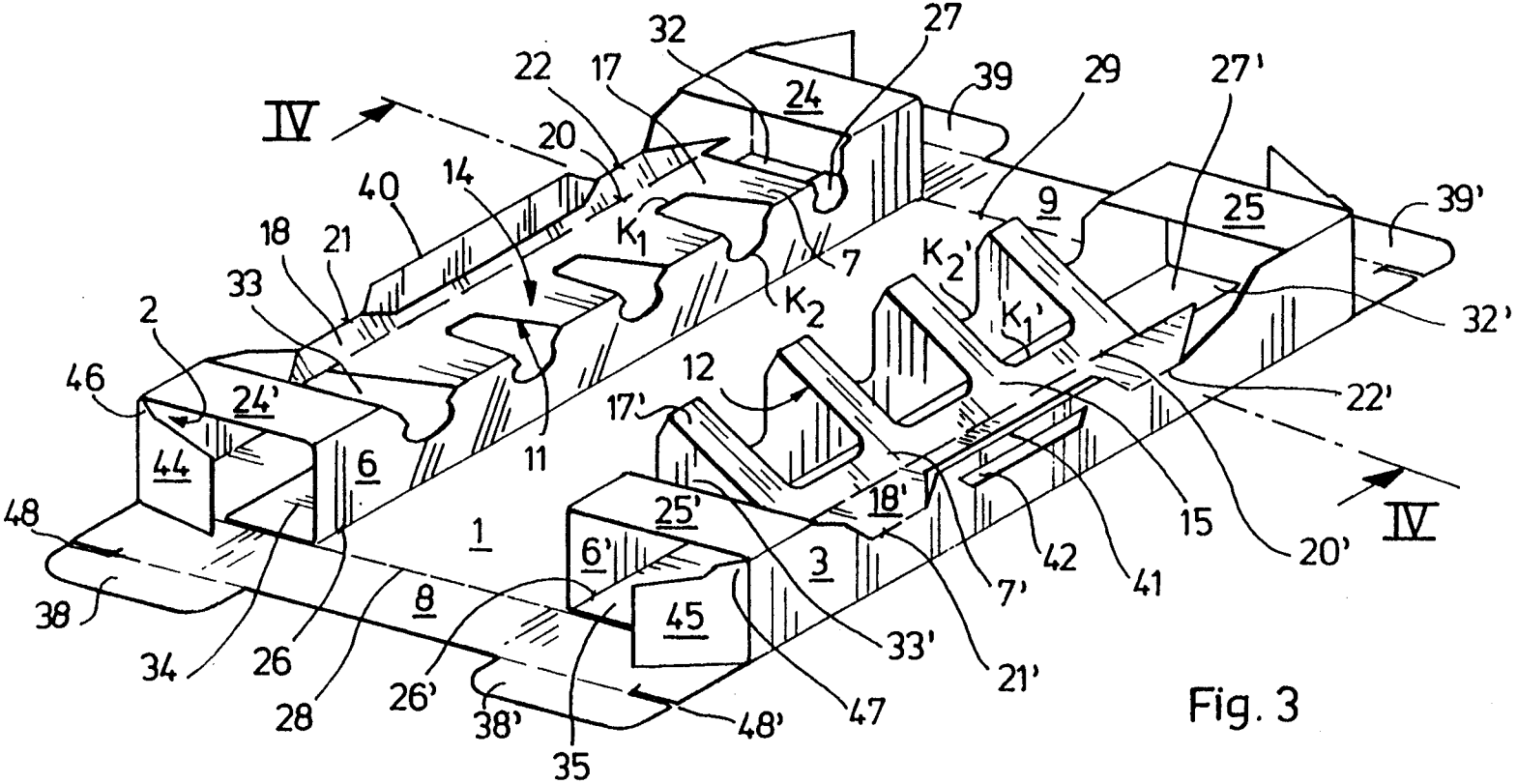
FIG. 3 shows a perspective representation of a preferred embodiment of the box in accordance with the invention.

A perspective plan view of a partially assembled box in a preferred embodiment according to the invention is represented in FIG. 3 in which a central section 14 and 15 of the hollow wall 4 and 5 is configured in the manner already described with respect to FIGS. 1 and 2 and the outer sections 24, 24' or 25, 25', each of which is adjacent in the lengthwise direction to one side of the middle sections 14 and 15 of the hollow walls 4 and 5, have a rectangular cross-section to form a parallelpiped shape at the front sides 34, 35 of the box. The middle sections 14 and 15 with the triangular cross-sections are seperated from the outer sections 24, 25 and 24', 25' by the cutouts 32, 33 and 32', 33' which extend through to the lengthwise sidewalls 2, 3, so that the support walls 7, 7' of the middle hollow wall sections 14, 15 do not join onto the support walls of the outer hollow wall sections with rectangular cross-section, rather are separated from them by the cutouts 32, 33 and 32', 33'. In accordance with FIG. 3, the first support wall sections 17, 17' are each connected to the second carrying wall sections 18, 18' by means of a perforation, forming a hinge joint 20, 20', and the second carrying wall sections 18, 18' are each sectionally connected to the lengthwise sidewalls 2 and 3 by means of the further hinge joints 21, 22 and 21', 22', respectively, which are in the form of perforation lines. The lengthwise sidewalls 2 and 3 thereby extend vertically in the sections 24, 24' and 25 and 25' of the hollow walls 4 and 5 and in the central sections not connected to the second support wall sections 18, 18', above these surfaces. The box represented in FIG. 3 can accept a total of 5 ampules in densely adjacent packaging in the cutouts 11, 12 as well as in the cutouts 32, 33 and 32', 33', whereby, as mentioned, the ampules which are stored in the middle sections 14, 15 of the hollow wall 4, 5 lie on the edges K1, K2 and K1', K2', respectively, of each of the carrying wall sections 17, 17' and the reinforcement walls 6, 6' and, furthermore, are held in a lightly clamping fashion in the cutouts 11, 12. Extending out from a base line 26, 26', a base strip 27, 27' forming a glueing tab joins onto each of the support walls 6, 6', each of which, when assembling the box from the blank, is folded inwardly, e.g. towards the inside of the hollow walls 4, 5 and is glued to the bottom in such a fashion, that angles between the bottom 1 and the reinforcement wall 6, 6' labelled W and W' in FIG. 1 are formed which are less than 90°. In accordance with FIG. 3, side tabs 8 and 9 join the bottom 1 via fold lines 28 and 29. To connect these side tabs 8, 9, which form transverse side walls to the lengthwise side walls 2, 3, in order to close the front sided ends 34, 35 of the box in its assembled state, the side taps 8,9 each exhibit insertion tabs 38, 38' and 39, 39' and the lengthwise side walls 2 and 3 each exhibit a folding tab 44, 45 extension. The folding tabs 44, 45 come to rest in the assembled state in the inside of the side tabs 8, 9 and exhibit locking toes 46 and 47 which cooperate with locking slits 48, 48' of the insertion tabs 38, 38' and 39, 39' so that a gluing of the assembled side tabs onto their insertion tabs is not necessary. In the box represented in FIG. 3, it is important that the hollow walls comprising the support wall section 17, 18 or 17', 18', and the reinforcement walls 6, 6' form a flexible and resilient storage for holding the ampules which are not shown in FIG. 3, by means of the construction already described in connection with FIGS. 1 and 2, with triangular cross-section and with carrier wall sections 17, 18 and 17', 18' flexibly joined at the corners 20, 20', so that the ampules 10 which lie in the various cutouts, are protected not only against sidewards shock but also against pressure and shock from above or below. Thereby, the ampules do not lie on the bottom of the box 1 rather, essentially, on the edges K1, K2 or K1', K2'.

FIG. 4 again shows a cross-section along the cut line plane IV—IV of FIG. 3 which illustrates that the middle sections 14 and 14' of the hollow walls 14 and 15 have the triangular cross-section which has already been shown in FIG. 1.

Figure 5:
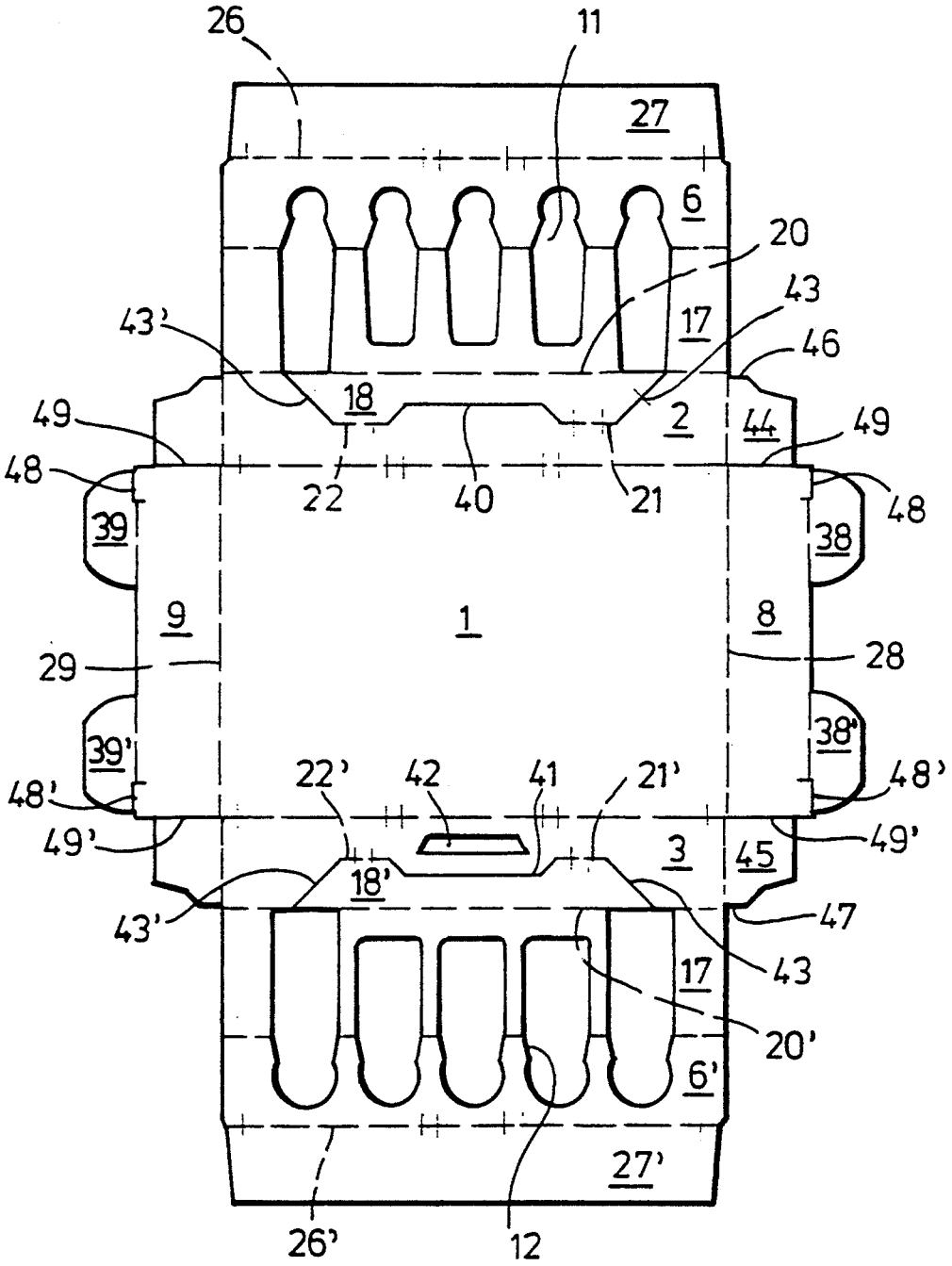
FIG. 5 shows a folding blank of the preferred box shown in its folded-up state in FIG. 3.

The box represented in FIG. 3 can be constructed from a folding blank, by way of example, made from cardboard with the usual fabrication steps. Such a blank is shown in FIG. 5. It is punched out of cardboard, whereby the cutouts 11, 12 are punched out and the cutlines 40, 41, 43, 43', 48, 48' and 49, 49' are cut through or punched through. Similarly, a cutout 42 is punched out in the lengthwise side wall 3. The line sections 21, 21' and 22, 22' as well as 26 and 26' in the line sections joining the lengthwise sidewalls 2 and 3 with the bottom 1 are perforation lines which allow for hinged joints.

Figure 6:
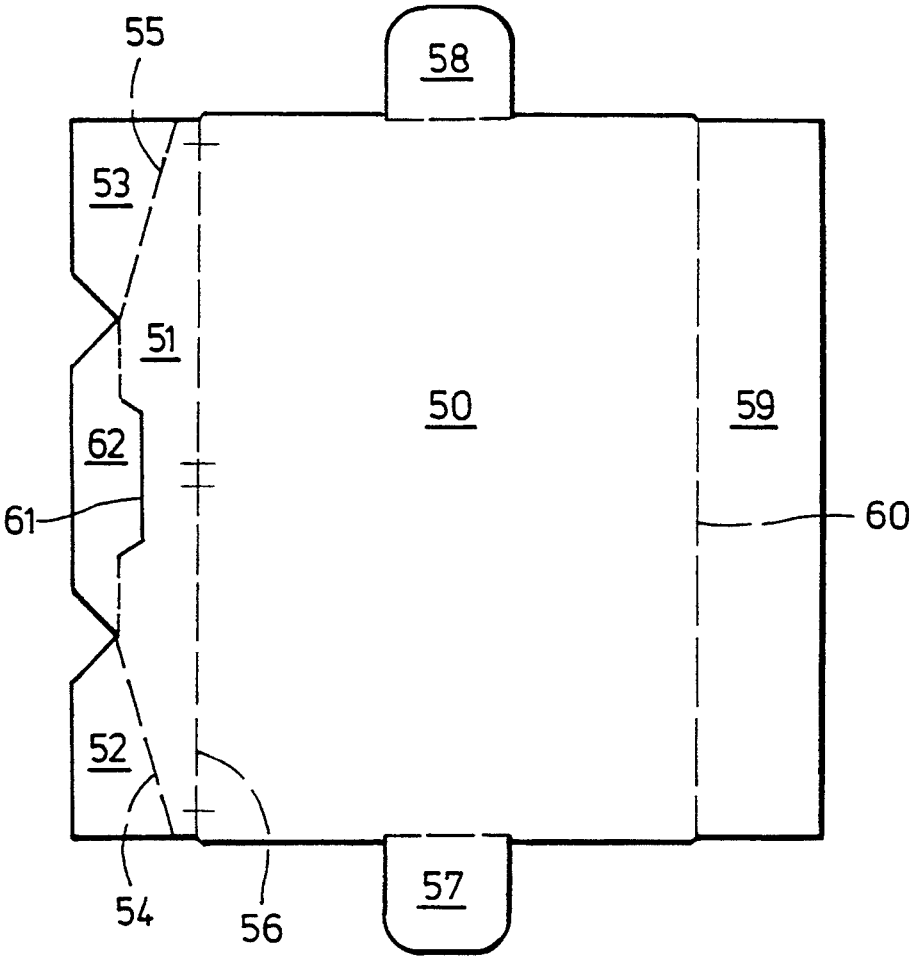
FIG. 6 shows a folding blank for a preferred hinged cover.

Finally, FIG. 6 shows a blank for a hinged cover 50 serving as an upper sided seal of the box, which is likewise stamped out of cardboard. The middle section of the hinged cover 50 covers the upper side of the box and is glueable at side sections 52, 53 and 59 to the oppositely lying lengthwise side walls 3 and 2 of the box. The line cuts 54 and 55 are perforation lines along which the hinged cover can be separated by opening the sections 52, 53 which are glued to the lengthwise sidewall 3 of the box and which thereby constitute a first-opening seal. The lines 56 and 60 represent joint perforations and, when the cover is closed, the sideward tabs 57 and 58 are inserted into the side tabs 8 and 9 which form the cross side walls of the box. Furthermore, the cover 50 is punched or cut through along the line section 61 so that it is possible, even after the cover has been opened, to close it again, in that the section 62 which is hinged in a bending fashion to the section 51 of the hinge cover, is, by means of the free tabs along the line 61, inserted into the opening 42 of the lengthwise sidewall 3.

Figure 4:
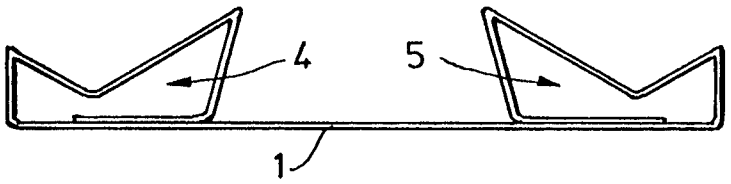
FIG. 4 shows a section through the preferred embodiment in accordance to FIG. 3 along the the cut line IV—IV.

With the above-described features, the box in accordance with the invention or the box insert in accordance with the invention has the following advantages:

- by means of the cross-sectionally triangular shaped hollow walls for the storage of the ampules or the like, which allow for a four-point support of the ampules, a safe ampule storage with respect to pressure and shock is facilitated;
- the ampules lie with both ends free from the carton material of the box and even when the box is completely filled can be easily removed with the fingers;
- the special construction of the hollow walls 4 and 5, which is, by way of example, viewable in FIG. 4 causes the ampules or the like, despite pressure, not to lie on the bottom of the box. When there is pressure on the cover, the packed objects are flexibly and resiliently stored;
- finally the new box construction has the advantage that its outer dimensions and its weight are reduced relative to comparable boxes known in prior art.

We claim:

1. A box, adapted for storing an ampule, having two substantially parallel hollow walls lying at a separation from each other, with each hollow wall comprising a reinforcement wall, extending outward from a box bottom, and a support wall, attached to the reinforcement wall and at least partially attached to a neighboring lengthwise sidewall, wherein the two hollow walls comprise cutouts in pairwise alignment and each hollow wall comprises a middle region having a triangular shaped cross-section, and each support wall comprises a first section, extending from an upper end of the reinforcement wall towards the box bottom, and a second section, joined to the first section, extending upwardly to the neighboring lengthwise sidewall, whereby a stored ampule is seated in the middle region with each end free from each support wall.

2. The box of claim 1, wherein the cutouts, in proximity to the reinforcement walls, are adapted to hold an ampule in a clamping fashion and, in proximity to the support walls, are so configured that a held ampule lies with its lower side on an upper edge of the support wall.

3. The box of claim 1, wherein the first and the second sections of the support wall are joined by means of a first hinge joint, and the cutouts are located within the first support wall section.

4. The box of claim 1, wherein the support wall second section is joined with the neighboring lengthwise sidewall at two separated sections via a second and third hinge joint.

5. The box of claim 1, wherein each hollow wall further comprises two outer regions, on either side of the middle region, each having a rectangular cross-section and the support wall first and second sections and the reinforcement wall of the middle region are separated from the two outer regions by an outer cutout which extends from the reinforcement wall and support wall to the sidewall of the outer region.

6. The box of claim 1, wherein the box bottom, the sidewalls and the hollow walls are made from one single blank.

7. The box of claim 1, wherein each reinforcement wall is joined to the bottom by means of a base strip, integral with the reinforcement wall, configured as a gluing tab.

8. The box of claim 7, wherein each base strip is folded over from a base line of the reinforcement wall to the inside of the hollow wall and is glued to the box bottom.

9. The box of claim 1, further comprising side tabs, erectable to constitute end walls, integral with the box bottom which are joined to the box bottom at a told line perpendicular to the lengthwise sidewalls, wherein the side tabs comprise insertion tabs which, when the side tabs are erect, insert into the hollow walls to close them at their ends.

10. The box of claim 9, further comprising, at the ends of the hollow walls, folding tabs attached to and extending from each lengthwise sidewall which are folded in to seat within the erected side tabs, wherein the insertion tabs comprise locking slits and the folding tabs comprise locking toes, cooperating with the locking slits, whereby the side tabs are joined in a locking fashion to the lengthwise sidewalls to close the hollow walls at their ends.

11. The box of claim 9, further comprising folding tabs, attached to and extending from each lengthwise side wall, wherein the erected side tabs are glued to the folding tabs to seal the hollow walls at their ends.

12. The box of claim 1, wherein the box bottom and all of the walls are formed by folding a single cardboard blank.

13. The box of claim 1, further comprising a hinged cover, made from a single piece, glued to an outer side of one lengthwise sidewall to seal the box means, the cover being firmly attached, in a tearable fashion, to the other lengthwise sidewall by means of a closing flap.

14. The box of claim 13, wherein the closing flap comprises a first section, attached to the closing flap by means of a perforation line, glued to the outer side of one lengthwise sidewall, wherein the perforation line is adapted to constitute a first-opening seal.

15. The box of claim 13, wherein the hinged cover is formed by folding a single cardboard blank.

* * * * *

UNITED STATES PATENT AND TRADEMARK OFFICE

CERTIFICATE OF CORRECTION

PATENT NO. : 5 361 907

DATED : November 8, 1994

INVENTOR(S) : Klaus Mohrhaeuser

It is certified that error appears in the above-indentified patent and that said Letters Patent is hereby corrected as shown below:

Column 8, line 1; change "told" to ---fold---.

Signed and Sealed this

Fourth Day of April, 1995

*Attest:*

BRUCE LEHMAN

*Attesting Officer*

*Commissioner of Patents and Trademarks*